US007003467B1

(12) United States Patent
Smith et al.

(10) Patent No.: US 7,003,467 B1
(45) Date of Patent: Feb. 21, 2006

(54) METHOD OF DECODING TWO-CHANNEL MATRIX ENCODED AUDIO TO RECONSTRUCT MULTICHANNEL AUDIO

(75) Inventors: William P. Smith, County Down (IE); Stephen M. Smyth, Newtownards (IE); Ming Yan, Bangor (IE)

(73) Assignee: Digital Theater Systems, Inc., Agoura Hills, CA (US)

( * ) Notice: Subject to any disclaimer, the term of this patent is extended or adjusted under 35 U.S.C. 154(b) by 708 days.

(21) Appl. No.: 09/680,737

(22) Filed: Oct. 6, 2000

(51) Int. Cl.
*G10L 19/00* (2006.01)

(52) U.S. Cl. ..... 704/500; 704/205; 704/201; 704/268; 381/19; 381/22

(58) Field of Classification Search ..... 704/205, 704/500, 268, 201; 381/22, 19
See application file for complete search history.

(56) References Cited

U.S. PATENT DOCUMENTS

| | | | | | |
|---|---|---|---|---|---|
| 4,704,728 | A | * | 11/1987 | Scheiber | 381/22 |
| 5,046,098 | A | * | 9/1991 | Mandell et al. | 381/22 |
| 5,274,740 | A | * | 12/1993 | Davis et al. | 704/203 |
| 5,307,415 | A | * | 4/1994 | Fosgate | 381/22 |
| 5,796,844 | A | * | 8/1998 | Griesinger | 381/18 |
| 5,870,480 | A | * | 2/1999 | Griesinger | 381/18 |
| 6,021,386 | A | * | 2/2000 | Davis et al. | 704/229 |

FOREIGN PATENT DOCUMENTS

| | | | |
|---|---|---|---|
| WO | WO 01/41504 A1 | | 6/2001 |
| WO | WO 01/41505 A1 | | 6/2001 |
| WO | WO 02/19768 | * | 8/2001 |
| WO | WO 02/19768 A2 | | 3/2002 |

OTHER PUBLICATIONS

Dressler, Roger. Dolby Surround Pro Logic II Decoder Principles of Operation, (2000), Dolby Laboratories p. 1-7.*
Dressler, Roger. Dolby Pro Logic Surround Decoder Principles of Operation, Aug. 29, 2000, Dolby Laboratories, www.dolby.com/tech/whtppr.html.*
Dressler, Roger, *Dolby Surround Pro Logic II Decoder Principles of Operation*, (2000), Dolby Laboratories Dolby Surround Pro Logic II, p. 1-7.
Dressler, Roger, *Dolby Pro Logic Surround Decoder Principles of Operation*, Aug. 29, 2000, Dolby Laboratories, www.dolby.com/tech/whtppr.html.

* cited by examiner

*Primary Examiner*—Vijay Chawan
(74) *Attorney, Agent, or Firm*—Blake A. Welcher; William L. Johnson; Eric A. Gifford

(57) ABSTRACT

The present invention provides a method of decoding two-channel matrix encoded audio to reconstruct multichannel audio that more closely approximates a discrete surround-sound presentation. This is accomplished by subband filtering the two-channel matrix encoded audio, mapping each of the subband signals into an expanded sound field to produce multichannel subband signals, and synthesizing those subband signals to reconstruct multichannel audio. By steering the subbands separately about an expanded sound field, various sounds can be simultaneously positioned about the sound field at different points allowing for more accurate placement and more distinct definition of each sound element.

16 Claims, 8 Drawing Sheets

METHOD OF DECODING TWO-CHANNEL MATRIX ENCODED AUDIO TO RECONSTRUCT MULTICHANNEL AUDIO

BACKGROUND OF THE INVENTION

1. Field of the Invention

This invention relates to multichannel audio and more specifically to a method of decoding two-channel matrix encoded audio to reconstruct multichannel audio that more closely approximates a discrete surround-sound presentation.

2. Description of the Related Art

Multichannel audio has become the standard for cinema and home theater, is gaining rapid acceptance in music, automotive, computers, gaming and other audio applications, and is being considered for broadcast television. Multichannel audio provides a surround-sound environment that greatly enhances the listening experience and the overall presentation of any audio-visual system. The move from stereo to multichannel audio has been driven by a number of factors paramount among them being the consumers' desire for higher quality audio presentation. Higher quality means not only more channels but higher fidelity channels and improved separation or "discreteness" between the channels. Another important factor to consumer and manufacturer alike is retention of backward compatibility with existing speaker systems and encoded content and enhancement of the audio presentation with those existing systems and content.

The earliest multichannel systems matrix encoded multiple audio channels, e.g. left, right, center and surround (L,R,C,S) channels, into left and right total (Lt,Rt) channels and recorded them in the standard stereo format. Although these two-channel matrix encoded systems such as Dolby Prologic™ provided surround-sound audio, the audio presentation is not discrete but is characterized by crosstalk and phase distortion. The matrix decoding algorithms identify a single dominant signal and position that signal in a 5-point sound-field accordingly to then reconstruct the L, R, C and S signals. The result can be a "mushy" audio presentation in which the different signals are not clearly spatially separated, particularly less dominant but important signals may be effectively lost.

The current standard in consumer applications is discrete 5.1 channel audio, which splits the surround channel into left and right surround channels and adds a subwoofer channel (L,R,C,Ls,Rs,Sub). Each channel is compressed independently and then mixed together in a 5.1 format thereby maintaining the discreteness of each signal. Dolby AC-3™, Sony SDDS™ and DTS Coherent Acoustics™ are all examples of 5.1 systems. Recently 6.1 channel audio, which adds a center surround channel Cs, has been introduced. Truly discrete audio provides a clear spatial separation of the audio channels and can support multiple dominant signals thus providing a richer and more natural sound presentation.

Having become accustomed to discrete multichannel audio and having invested in a 5.1 speaker system for their homes, consumers will be reluctant to accept clearly inferior surround-sound presentations. Unfortunately only a relatively small percentage of content is currently available in the 5.1 format. The vast majority of content is only available in a two-channel matrix encoded format, predominantly Dolby Prologic™. Because of the large installation of Prologic decoders, it is expected that 5.1 content will continue to be encoded in the Prologic format as well. Accordingly, there remains an unfulfilled need in the industry to provide a method of decoding two-channel matrix encoded audio to reconstruct multichannel audio that more closely approximates "discrete" multichannel audio.

Dolby Prologic™ provided one of the earliest two-channel matrix encoded multichannel systems. Prologic squeezes 4-channels (L,R,C,S) into 2-channels (Lt,Rt) by introducing a phase-shifted surround sound term. These 2-channels are then encoded into the existing 2-channel formats. Decoding is a two step process in which an existing decoder receives Lt,Rt and then a Prologic decoder expands Lt,Rt into L,R, C,S. Because four signals (unknowns) are carried on only two channels (equations), the Prologic decoding operation is only an approximation and cannot provide true discrete multichannel audio.

As shown in FIG. 1, a studio 2 will mix several, e.g. 48, audio sources to provide a four-channel mix (L,R,C,S). The Prologic encoder 4 matrix encodes this mix as follows:

$$Lt=L+0.707C+S(+90°), \text{ and} \tag{1}$$

$$Rt=R+0.707C+S(-90), \tag{2}$$

which are carried on the two discrete channels, encoded into the existing two-channel format and recorded on a media 6 such as film, CD or DVD.

A Prologic matrix decoder 8 decodes the two discrete channels Lt,Rt and expands them into four discrete reconstructed channels Lr,Rr,Cr and Sr that are amplified and distributed to a five speaker system 10. Many different proprietary algorithms are used to perform an active decode and all are based on measuring the power of Lt+Rt, Lt−Rt, Lt and Rt to calculate gain factors Gi whereby, $$Lr=G1*Lt+G2*Rt \tag{3}$$

$$Rr=G3*Lt+G4*Rt \tag{4}$$

$$Cr=G5*Lt+G6*Rt, \text{ and} \tag{5}$$

$$Sr=G7*Lt+G8*Rt. \tag{6}$$

More specifically, Dolby provides a set of gain coefficients for a null point at the center of a 5-point sound field 11 as shown in FIG. 2. The decoder measures the absolute power of the two-channel matrix encoded signals Lt and Rt and calculates power levels for the L,R,C and S channels according to:

$$Lpow(t)=C1*Lt+C2*Lpow(t-1) \tag{7}$$

$$Rpow(t)=C1*Rt+C2*Rpow(t-1) \tag{8}$$

$$Cpow(t)=C1*(Lt+Rt)+C2*Cpow(t-1) \tag{9}$$

$$Spow(t)=C1*(Lt-Rt)+C2*Spow(t-1) \tag{10}$$

where C1 and C2 are coefficients that dictate the degree of time averaging and the (t−1) parameters are the respective power levels at the previous instant.

These power levels are then used to calculate L/R and C/S dominance vectors according to:

$$\text{If } Lpow(t)>Rpow(t),\ Dom\ L/R=1-Rpow(t)/Lpow(t),\ \text{else } Dom\ L/R=Lpow(t)/Rpow(t)-1, \tag{11}$$

and $$\text{If } Cpow(t)>Spow(t),\ Dom\ C/S=1-Spow(t)/Cpow(t),\ \text{else } Dom\ C/R=Cpow(t)/Spow(t)-1. \tag{12}$$

The vector sum of the L/R and C/S dominance vectors defines a dominance vector 12 in the 5-point sound field from which the single dominant signal should emanate. The decoder scales the set of gain coefficients at the null point according to the dominance vectors as follows:

$$[G]_{Dom}=[G]_{Null}+Dom\ L/R*[G]_R+Dom\ C/S*[G]_C \quad (13)$$

where [G] represents the set of gain coefficients G1, G2, . . . G8.

This assumes that the dominant point is located in the R/C quadrant of the 5-point sound field. In general the appropriate power levels are inserted into the equation based on which quadrant the dominant point resides. The $[G]_{Dom}$ coefficients are then used to reconstruct the L,R,C and S channels according to equations 3–6, which are then passed to the amplifiers and onto the speaker configuration.

When compared to a discrete 5.1 system the drawbacks are clear. The surround-sound presentation includes crosstalk and phase distortion and at best approximates a discrete audio presentation. Signals other than the single dominant signal, which either emanate from different locations or reside in different spectral bands, tend to get washed out by the single dominant signal.

5.1 surround-sound systems such as Dolby AC-3™, Sony SDDS™ and DTS Coherent Acoustics™ maintain the discreteness of the multichannel audio thus providing a richer and more natural audio presentation. As shown in FIG. 3, the studio 20 provides a 5.1 channel mix. A 5.1 encoder 22 compresses each signal or channel independently, multiplexes them together and packs the audio data into a given 5.1 format, which is recorded on a suitable media 24 such as a DVD. A 5.1 decoder 26 decodes the bitstream a frame at a time by extracting the audio data, demultiplexing it into the 5.1 channels and then decompressing each channel to reproduce the signals (Lr,Rr,Cr,Lsr,Rsr,Sub). These 5.1 discrete channels, which carry the 5.1 discrete audio signals are directed to the appropriate discrete speakers in speaker configuration 28 (subwoofer not shown).

SUMMARY OF THE INVENTION

In view of the above problems, the present invention provides a method of decoding two-channel matrix encoded audio to reconstruct multichannel audio that more closely approximates a discrete surround-sound presentation.

This is accomplished by subband filtering the two-channel matrix encoded audio, mapping each of the subband signals into an expanded sound field to produce multichannel subband signals, and synthesizing those subband signals to reconstruct multichannel audio. By steering the subbands separately about an expanded sound field, various sounds can be simultaneously positioned about the sound field at different points allowing for more accurate placement and more distinct definition of each sound element.

The process of subband filtering provides for multiple dominant signals, one in each of the subbands. As a result, signals that are important to the audio presentation that would otherwise be masked by the single dominant signal are retained in the surround-sound presentation provided they lie in different subbands. In order to optimize the tradeoff between performance and computations a bark filter approach may be preferred in which the subbands are tuned to the sensitivity of the human ear.

By expanding the sound field, the decoder can more accurately position audio signals in the sound field. As a result, signals that would otherwise appear to emanate from the same location can be separated to appear more discrete. To optimize performance it may be preferred to match the expanded sound field to the multichannel input. For example, a 9-point sound field provides discrete points, each having a set of optimized gain coefficients, including points for each of the L,R,C,Ls,Rs and Cs channels.

These and other features and advantages of the invention will be apparent to those skilled in the art from the following detailed description of preferred embodiments, taken together with the accompanying drawings, in which:

DETAILED DESCRIPTION OF THE INVENTION

The present invention fulfills the industry need to provide a method of decoding two-channel matrix encoded audio to reconstruct multichannel audio that more closely approximates "discrete" multichannel audio. This technology will most likely be incorporated in multichannel A/V receivers so that a single unit can accommodate true 5.1 (or 6.1) multichannel audio as well as two-channel matrix encoded audio. Although inferior to true discrete multichannel audio, the surround-sound presentation from the two-channel matrix encoded content will provide a more natural and richer audio experience. This is accomplished by subband filtering the two-channel audio, steering the subband audio within an expanded sound field that includes a discrete point with optimized gain coefficients for each of the speaker locations and then synthesizing the multichannel subbands to reconstruct the multichannel audio. Although the preferred implementation utilizes both the subband filtering and expanded sound-field features, they can be utilized independently.

Figure 1:
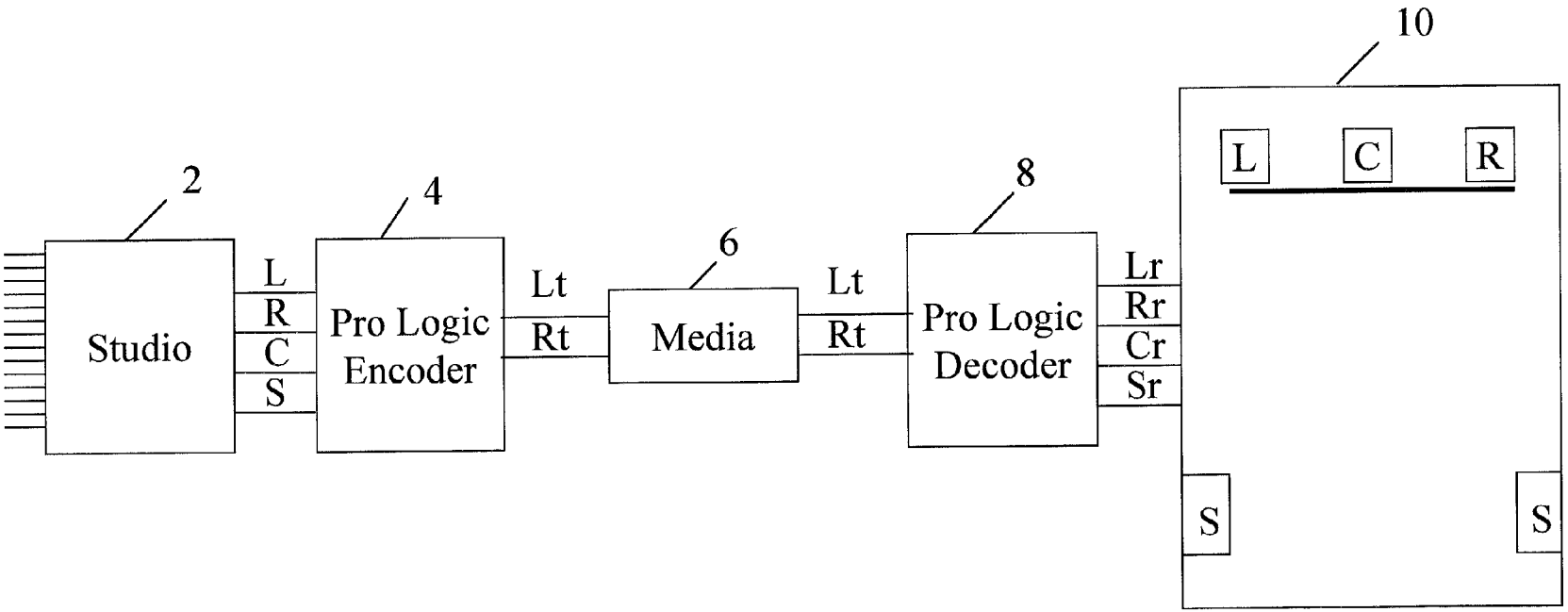
FIG. 1 (Prior Art)
FIG. 1, as described above, is a block diagram of a two-channel matrix encoded surround-sound system.
Figure 2:
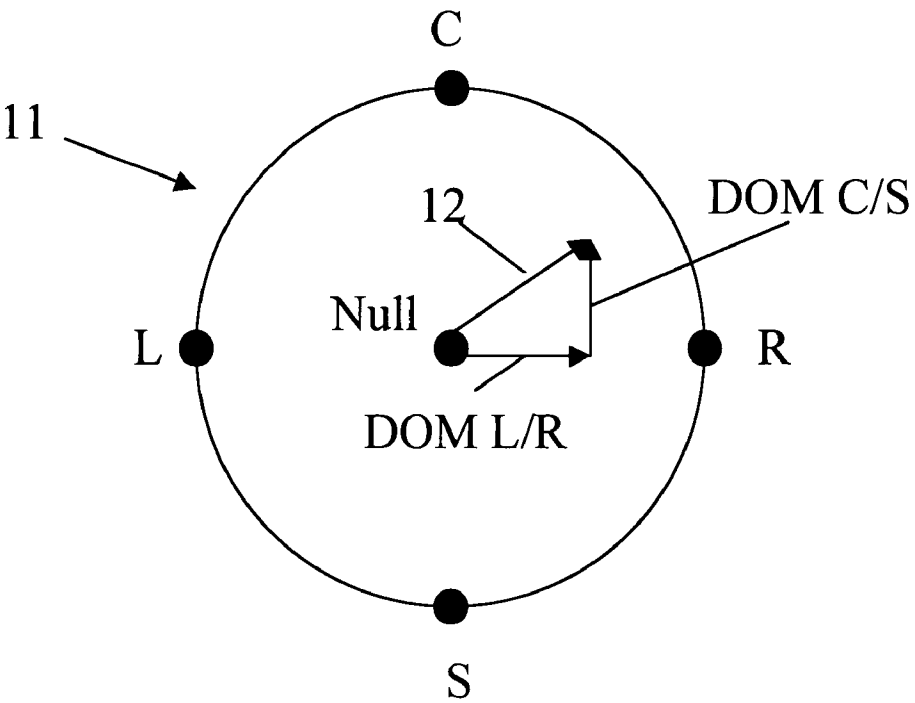
FIG. 2 (Prior Art)
FIG. 2, as described above, is an illustration of a 5-point sound field.
Figure 3:
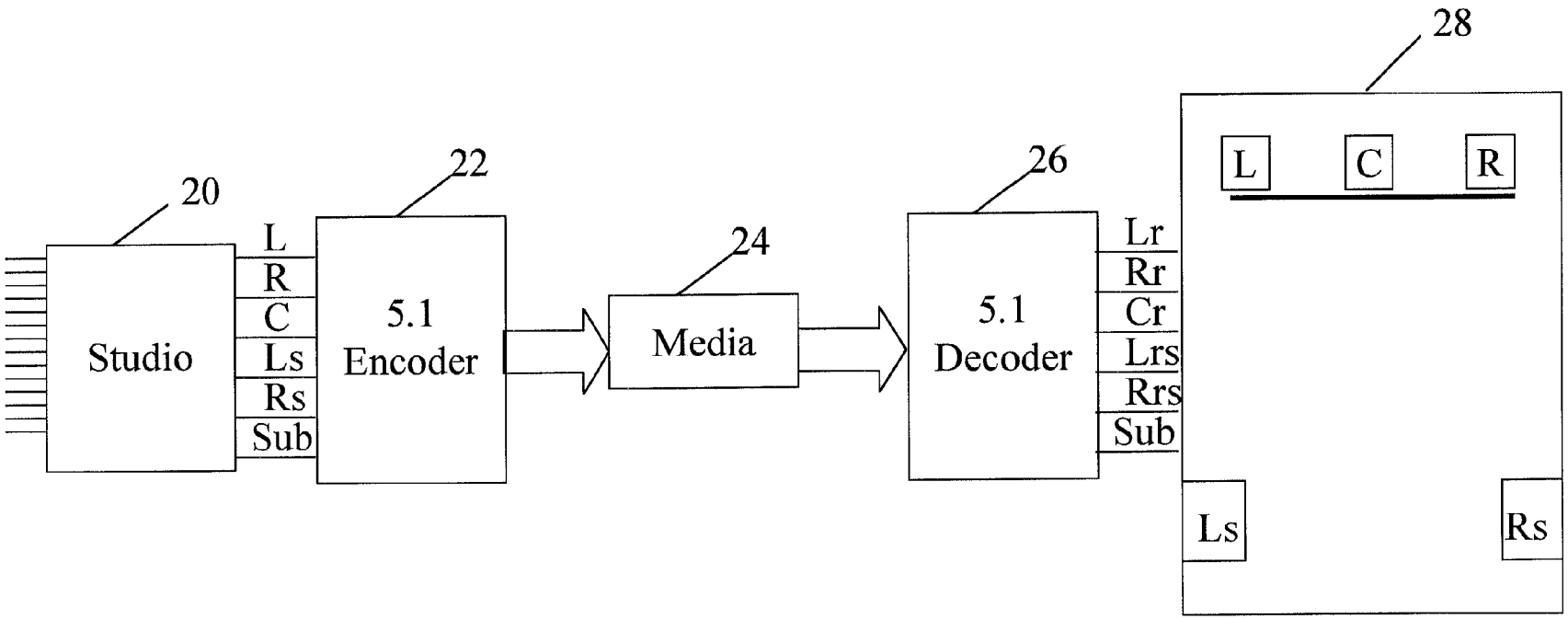
FIG. 3 (Prior Art)
FIG. 3, as described above, is a block diagram of a 5.1 channel surround-sound system.
Figure 4:
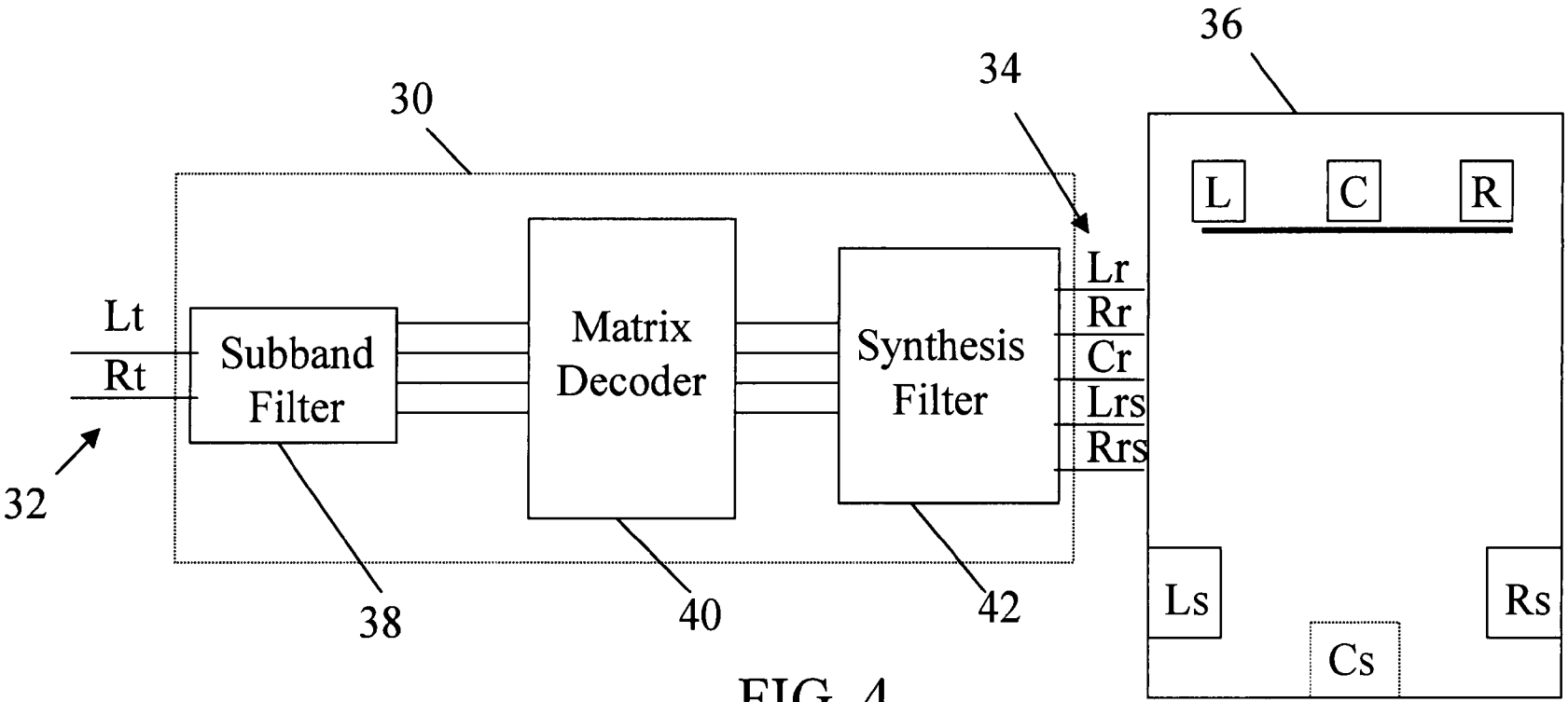
FIG. 4 is a block diagram of a decoder for reconstructing multichannel audio from two-channel matrix encoded audio in accordance with the present invention.

As depicted in FIG. 4, a decoder 30 receives a two-channel matrix encoded signal 32 (Lt,Rt) and reconstructs a multichannel signal 34 that is then amplified and distributed to speakers 36 to present a more natural and richer surround-sound experience. The decoding algorithm is independent of the specific two-channel matrix encoding, hence signal 32 (Lt,Rt) can represent a standard ProLogic mix (L,R,C,S), a 5.0 mix (L,R,C,Ls,Rs), a 6.0 mix (L,R,C,Ls,Rs,Cs) or other. Reconstruction of the multichannel audio is dependent on the user's speaker configuration. For example, for a 6.0 signal the decoder will generate a discrete center surround Cs channel if a Cs speaker exists otherwise that signal will be mixed down into the Ls and Rs channels to provide a phantom center surround. Similarly if the user has less than 5 speakers the decoder will mix down. Note, the subwoofer or 0.1 channel is not included in the mix. Bass response is provided by separate software that extracts a low frequency signal from the reconstructed channel and is not part of the invention.

Figure 5:
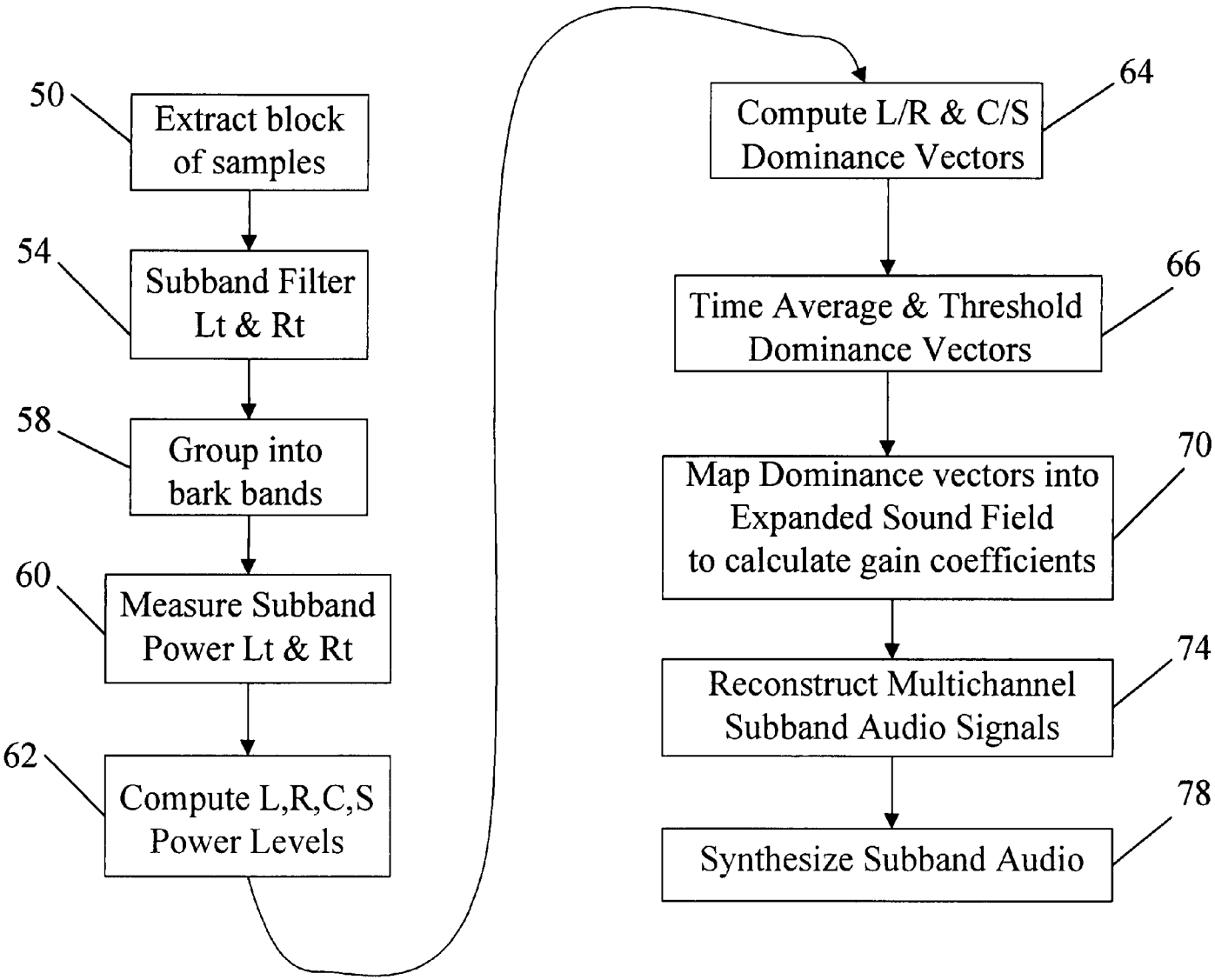
FIG. 5 is a flow chart illustrating the steps to reconstruct multichannel audio from two-channel matrix encoded audio in accordance with the present invention.

Decoder 30 includes a subband filter 38, a matrix decoder 40 and a synthesis filter 42, which together decode the two-channel matrix encoded audio Lt and Rt and reconstruct the multichannel audio. As illustrated in FIG. 5 the decoding and reconstruction entails a sequence of steps as follows:

1. Extract a block of samples, e.g. 64, for each input channel (Lt,Rt) (step 50).

Figure 6A:
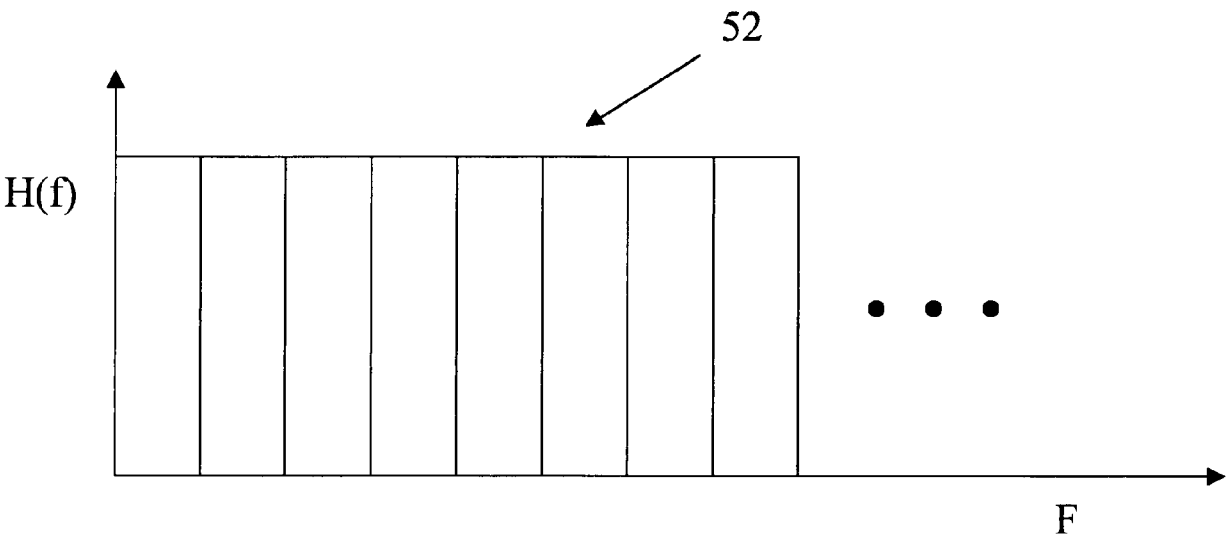
FIGS. 6*a* and 6*b* respectively illustrate the subband filters and synthesis filter shown in FIG. 4 used to reconstruct the discrete multichannel audio.

2. Filter each block using the multi-band filter bank 38, e.g. a 64-band polyphase filter bank 52 of the type shown in FIG. 6*a*, to form subband audio signals (step 54).

Figure 7:
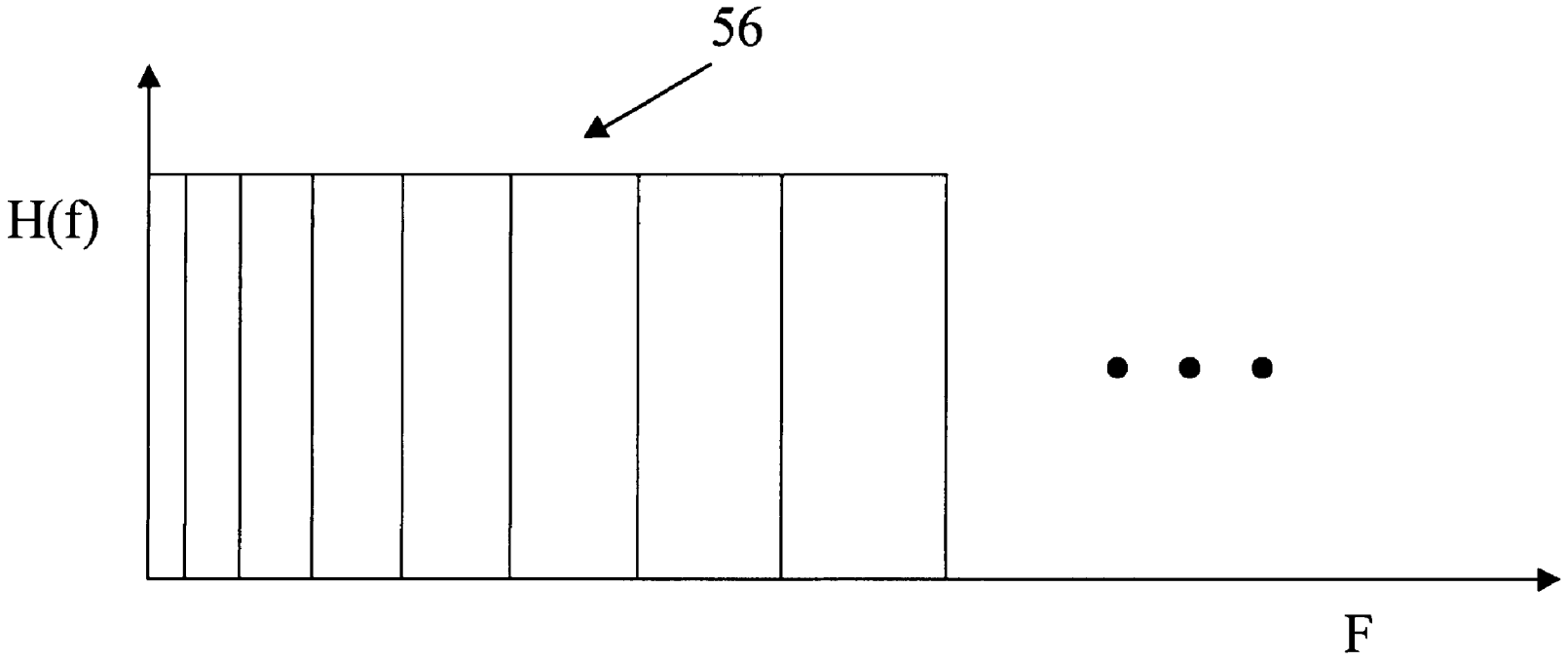
FIG. 7 illustrates a particular Bark subband filter.

3. (Optional) Group the resulting subband samples into the closest resulting bark bands 56 as shown in FIG. 7 (step 58). The bark bands may be further combined to reduce computational load.

4. Measure power level for each of the Lt and Rt subbands (step 60).

5. Compute the power levels for each of the L,R,C and S subbands (step 62).

$$Lpow(t)^i=C1*Lt+C2*Lpow^i(t-1) \quad (14)$$

$$Rpow(t)^i=C1*Rt+C2*Rpow^i(t-1) \quad (15)$$

$$Cpow(t)^i=C1*(Lt+Rt)+C2*Cpow^i(t-1) \quad (16)$$

$$Spow(t)^i=C1*(Lt-Rt)+C2*Spow^i(t-1) \quad (17)$$

where i indicates the subband, C1 and C2 are the time averaging coefficients, and (t−1) indicates the previous instance.

6. Compute the L/R and C/S dominance vectors for each subband (step 64).

$$\text{If } Lpow(t)^i>Rpow(t)^i,\ DomL/R^i=1-Rpow(t)^i/Lpow(t)^i,\ \text{else } Dom\ L/R^i=Lpow(t)^i/Rpow(t)^i-1, \quad (18)$$

and $$\text{If } Cpow(t)^i>Spow(t)^i,\ DomC/S^i=1-Spow(t)^i/Cpow(t)^i,\ \text{else } Dom\ C/R^i=Cpow(t)^i/Spow(t)^i-1. \quad (19)$$

7. Average the L/R and C/S dominance vectors for each subband using both a slow and fast average and threshold to determine which average will be used to calculate the matrix variables (step 66). This allows for quick steering where appropriate, i.e. large changes, while avoiding unintended wandering.

Figure 8:
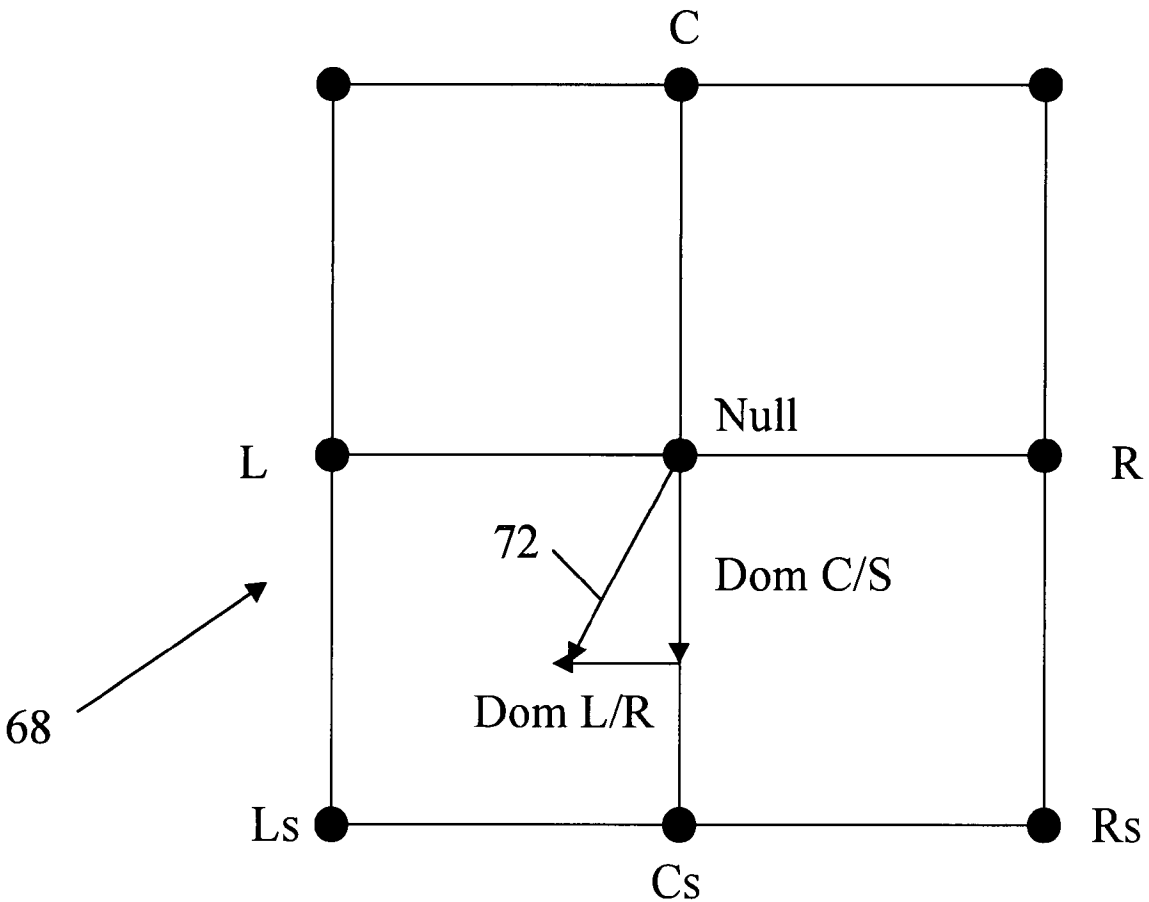
FIG. 8 is an illustration of a 9-point expanded sound field that matches the discrete multichannel audio presentation.

8. Map the Lt,Rt subband signals into an expanded sound field 68 of the type shown in FIG. 8, which matches the motion picture/DVD channel configuration for speaker placement (step 70). A grid of nine points (expandable with greater processor power) identifies locations in acoustic space. Each point corresponds to a set of gain values G1, G2, . . . G12 represented by [G], which have been determined to produce the "best" outputs for each of the speakers when the L/R and C/S dominance vectors define a signal vector 72 corresponding to that point.

As defined in equations 18 and 19 above, Dom L/R and Dom C/S each have a value in the range [−1,1] where the sign of the dominance vectors indicates in which quadrant vector 72 resides and magnitude of the vector indicate the relative position within the quadrant for each subband.

The gain coefficients for signal vector 72 in each subband are preferably computed based on the values of the gain coefficients at the 4-corners of the quadrant in which signal vector 72 resides. One approach is to interpolate the gain coefficients at that point based on the coefficient values at the corner points.

The generalized interpolation equations for a point residing in the upper left quadrant are given by the following equations:

$$[G]_{vector}{}^i=D1^i*[G]_{Null}+D2^i*[G]_L+D3^i*[G]C+D4^i*[G]_{UL} \quad (20)$$

where D1, D2, D3 and D4 are the linear interpolation coefficients given by:

$D1^i$=1-distance between null (0,0) and vector 72, $D2^i$=1-distance between L (0,1) and vector 72, $D3^i$=1-distance between C (1,0) and vector 72, and $D4^i$=1-distance between UL (1,1) and vector 72 where "distance" is any appropriate distance metric.

Although higher order functions could be used, initial testing has indicated that a simple first order or linear interpolation performs the best where the coefficients are given by:

$$D1^i=(1-|Dom\ LR^i|-|Dom\ CS^i|+|Dom\ LR^i*|Dom\ CS^i|)$$

$$D2^i=(|Dom\ LR^i|-|Dom\ LR^i*|Dom\ C\ S^i|)$$

$$D3^i=(|Dom\ CS^i|-|Dom\ LR^i|*|Dom\ CS^i|)$$

$$D4^i=(|Dom\ LR^i*|Dom\ CS^i|)$$

where |*| is a magnitude function and i indicates the subband.

If signal vector 72 is coincident with the null point, the coefficients default to the null point coefficients. If the point lies in the center of the quadrant (½,½) then all four corner points contribute equally one-fourth of their value. If the point lies closer to one point that point will contribute more heavily but in a linear manner. For example if the point lies at (¼,¼), close to the null point, then the contributions are $\frac{9}{16}[G]_{Null}$, $\frac{3}{16}[G]_L$, $\frac{3}{16}[G]_C$ and $\frac{1}{16}[G]_{UL}$.

9. Reconstruct the multichannel subband audio signals according to (step 74):

$$Lr^i=G1^i*Lt^i+G2^i*Rt^i \quad (21)$$

$$Rr^i=G3^i*Lt^i+G4^i*Rt^i \quad (22)$$

$$Cr^i-G5^i*Lt^i+G6^i*Rt^i, \quad (23)$$

$$Lsr^i=G7^i*Lt^i+G8^i*Rt^i, \quad (24)$$

$$Rsr^i=G9^i*Lt^i+G10^i*Rt^i, \text{ and} \quad (25)$$

$$Csr^i=G11^i*Lt^i+G12^i*Rt^i \quad (26)$$

where $[G]_{vector}{}^i$ provide G1, G2, . . . G12.

Figure 6B:
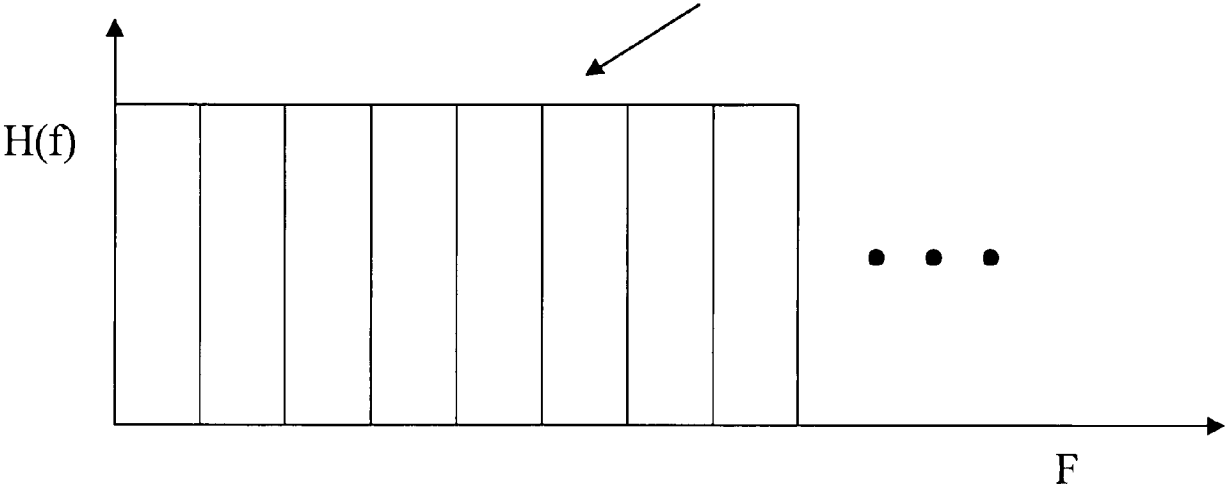

10. Pass the multichannel subband audio signals through synthesis filter 42 of the type shown in FIG. 6*b*, e.g. an inverse polyphase filter 76, to produce the reconstructed multichannel audio (step 78). Depending upon the audio content, the reconstructed audio may comprise multiple dominant signals, up to one per subband.

This approach has two principal advantages over known steered matrix systems such as Prologic:

1. By steering the subbands separately, various sounds can be positioned about the matrix at different points simultaneously, allowing for more accurate placement and more distinct definition of each sound element.

2. The present matrix observes the motion picture/DVD channel configuration of three front channels and two or three rear channels. Thus optimum use is made of a single loudspeaker layout for both 5.1/6.1 discrete DVDs, and Lt/Rt playback through the matrix.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A method of decoding two-channel matrix encoded audio to reconstruct multichannel audio that approximates a discrete surround-sound presentation, comprising:

subband filtering the two-channel matrix encoded audio into a plurality of two-channel subband audio signals;

separately in each of a plurality of subbands, steering the two-channel subband audio signals in a sound field to form multichannel subband audio signals; and synthesizing the multichannel subband audio signals in the subbands to reconstruct the multichannel audio.

2. The method of claim 1, wherein the reconstructed multichannnel audio comprises a plurality of dominant audio signals.

3. The method of claim 2, wherein said dominant audio signals reside in different subbands.

4. The method of claim 3, wherein steering the two-channel subband audio signals comprises computing a dominance vector in said sound field for each said subband, said dominance vector in each subband being determined by the dominant audio signals in that subband.

5. The method of claim 1, wherein subband filtering groups the subband audio signals into a plurality of bark bands.

6. The method of claim 1, wherein the two-channel matrix encoded audio includes at least left, right, center, left surround and right surround (L,R,C,Ls,Rs) audio channels, said two-channel subband audio signals being steered into an expanded sound field that includes a discrete point for each said audio channel.

7. The method of claim 6, wherein each said discrete point corresponds to a set of gain values predetermined to produce an optimized audio output at each of L,R,C,Ls,Rs speakers, respectively, when the two-channel subband audio signals are steered to that point in the expanded sound field.

8. The method of claim 7, wherein each said discrete point further includes a gain value predetermined to produce an optimized audio output at a center surround (Cs) speaker when the subband audio signal is steered to that point in the expanded sound field.

9. The method of claim 7, wherein steering the audio signals, comprises:

computing a dominance vector in said sound field for each said subband, said dominance vector being determined by the dominant audio signals in the subband;

using said dominance vectors and said predetermined gain values for said discrete points to compute a set of gain values for each subband; and using said two-channel subband audio signals and said gain values to compute the multichannel subband audio signals.

10. The method of claim 9, wherein the gain values for each subband are computed by performing a linear interpolation of the predetermined gain values surrounding the dominance vector to define the set of gain values at the point in the sound field indicated by the dominance vector.

11. The method of claim 1, wherein the expanded sound field comprises a 9-point sound field, each said discrete point corresponding to a set of gain values predetermined to produce an optimized audio output at each of L,R,C,Ls,Rs speakers, respectively, when the two-channel subband audio signals are steered to that point in the expanded sound field.

12. A method of decoding two-channel matrix encoded audio to reconstruct multichannel audio that approximates a discrete surround-sound presentation, comprising:

providing two-channel matrix encoded audio that includes at least left, right, center, left surround and right surround (L,R,C,Ls,Rs) audio channels;

subband filtering the two-channel matrix encoded audio into a plurality of two-channel subband audio signals;

separately in each of a plurality of subbands, steering the two-channel subband audio signals in an expanded sound field to form multichannel subband audio signals, said sound field having a discrete point for each said audio channel, each said discrete point corresponding to a set of gain values predetermined to produce an optimized audio output at each of L,R,C,Ls,Rs speakers, respectively, when the two-channel subband audio signals are steered to that point in the expanded sound field; and synthesizing the multichannel subband audio signals in the subbands to reconstruct the multichannel audio.

13. The method of claim 12, wherein the reconstructed multichannnel audio comprises a plurality of dominant audio signals that reside in different subbands.

14. The method of claim 12, wherein subband filtering groups the subband audio signals into a plurality of bark bands.

15. The method of claim 12, wherein each said discrete point further includes a gain value predetermined to produce an optimized audio output at a center surround (Cs) speaker when the subband audio signal is steered to that point in the expanded sound field.

16. The method of claim 12, wherein the expanded sound field comprises a 9-point sound field.

* * * * *